United States Patent [19]

DeVries

[11] 4,327,907

[45] May 4, 1982

[54] PORTABLE EXERCISE DEVICE

[76] Inventor: Daniel A. DeVries, 7749 Olive, Fair Oaks, Calif. 95628

[21] Appl. No.: 184,280

[22] Filed: Sep. 5, 1980

[51] Int. Cl.[3] ..... A63B 23/00

[52] U.S. Cl. ..... 272/93; 272/63; 272/144

[58] Field of Search ..... 272/61-64, 272/70, 70.3, 93, 109, 111, 113, 144, 67, 1 R; D21/191, 195, 198; 135/67

[56] References Cited

U.S. PATENT DOCUMENTS

| | | | |
|---|---|---|---|
| 192,338 | 6/1877 | Marshall . | |
| 1,570,307 | 1/1926 | Kirby | 272/93 X |
| 1,630,467 | 5/1927 | Bradstreet | 272/93 |
| 2,565,257 | 8/1951 | Nichol | 272/70.3 |
| 2,594,051 | 4/1952 | McFarland et al. | 135/67 X |
| 2,666,640 | 1/1954 | Jennings | 272/93 |
| 2,734,554 | 2/1956 | Ries | 272/70.3 |
| 2,899,204 | 8/1959 | Ratay | 272/62 X |
| 3,391,930 | 7/1968 | Weissman | 272/70.3 |
| 3,422,830 | 1/1969 | Cherup | 135/67 |
| 3,591,173 | 7/1971 | Cossman | 272/144 |
| 3,695,609 | 10/1972 | Rothe | 272/70.3 |
| 3,716,067 | 2/1973 | Skoog | 135/67 |
| 3,884,464 | 5/1975 | Evangelos . | |
| 3,942,790 | 3/1976 | Rice . | |
| 4,232,863 | 11/1980 | Roach | 272/111 |

FOREIGN PATENT DOCUMENTS

| | | | |
|---|---|---|---|
| 771089 | 7/1934 | France | 272/63 |
| 1498895 | 1/1978 | United Kingdom | 272/70 |

*Primary Examiner*—Richard J. Apley

*Attorney, Agent, or Firm*—Blair, Brown & Kreten

[57] ABSTRACT

A portable exercise device used in pairs for performing various exercises such as pushups, handstands and the like which includes a metal tube having a central portion and a pair of substantially identical U-shaped portions on opposite sides of the central portion which are bent into an angularly disposed relationship to define three sides in a triangular configuration with the central and U-shaped portions providing handgrip areas covered with anti-slip material so that each of the sides are adapted for overlying engagement with a supporting surface to selectively position one of the handgrip areas in an elevated position for gripping by the hand of a user.

9 Claims, 4 Drawing Figures

PORTABLE EXERCISE DEVICE

BACKGROUND OF THE INVENTION

It is generally recognized that physical fitness is an important part in maintaining one's longevity and sense of well-being. To this end, various types of systems have been provided which allow individuals the opportunity to achieve or maintain physical fitness. In some systems, a series of weight lifting stations are provided which allow an individual to isolate and exercise specific body portions to the exclusion of others. Other systems provide a single type of exercise device adapted to be manipulated in a plurality of ways so as to provide conditioning for various body parts with a minimum of equipment. To this end, a single exercise device suitable for a plurality of uses is quite efficient and meets a preferred ideal when a variety of exercises can be performed thereon. However, most such present day exercise devices permit only a minimum of uses and furthermore, are bulky, expensive and heavy while generally requiring an extensive set-up time and, in some cases, even associated support structures.

The following patents reflect the state of the art of which applicant is aware insofar as the structure appears to be germane to the instant application:

U.S. Pat. No. 192,338—Marshall

U.S. Pat. No. 3,884,464—Evangelos

U.S. Pat. No. 3,942,790—Rice

None of these references teach or suggest the configuration of the exercise device according to the instant application. For example, Evangelos provides a linear exerciser formed from plastic.

OBJECTS AND SUMMARY OF THE INVENTION

Accordingly, a primary object of this invention is to provide a new and novel exercise device which is readily portable and which is simple and inexpensive in construction.

Another object of this invention is to provide a new and novel exercise device which may be used in pairs to perform a wide variety of exercises such as pushups, handstands, stretching, pullups, isometrics and the like.

A further object of this invention is to provide a new and novel exercise device which inherently assumes an operative position for use by an individual for performing various exercises which will not slipon a supporting surface during use.

A still further object of this invention is to provide a new and novel exercise device which is formed in a unitary construction, which is extremely durable and which may be used in pairs to perform a variety of exercises.

These and other objects will be made manifest when considering the following detailed specification when taken in conjunction with the drawing figures.

DESCRIPTION OF THE PREFERRED EMBODIMENT

Figure 1:
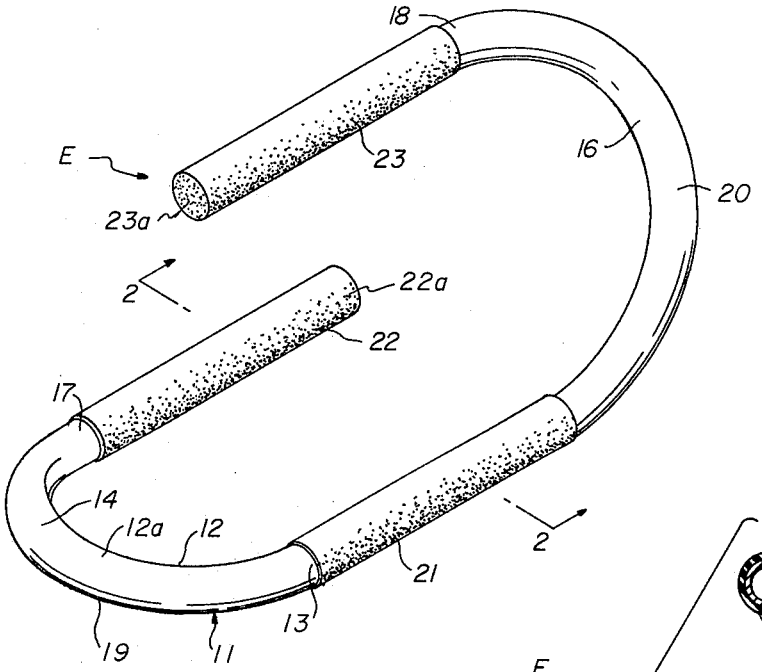
FIG. 1 is a perspective view of an exercise device constructed in accordance with the invention.

Referring now to the drawings, wherein like reference numerals refer to like parts throughout the various drawing figures, FIG. 1 illustrates an exercise device constructed in accordance with the invention which is designated generally by the letter E.

The exercise device E includes a body member 11 of rigid material having a unitary construction which, in the illustrated embodiment, comprises a metal tube 12 of uniform cross-sectional shape. The metal tube 12 has an outer surface 12*a* and includes a substantially straight central portion 13 forming a handgrip area. The metal tube 12 is bent on opposite sides of the central portion 13 to form a pair of U-shaped portions 14, 16 having free end portions 17, 18 and bight portions 19, 20 respectively which are arranged in transverse, angularly disposed relationship, as shown best in FIG. 2 to define three sides S, S′ and S″ for the body member 11 or tube 12 disposed in a triangular configuration.

Figure 2:
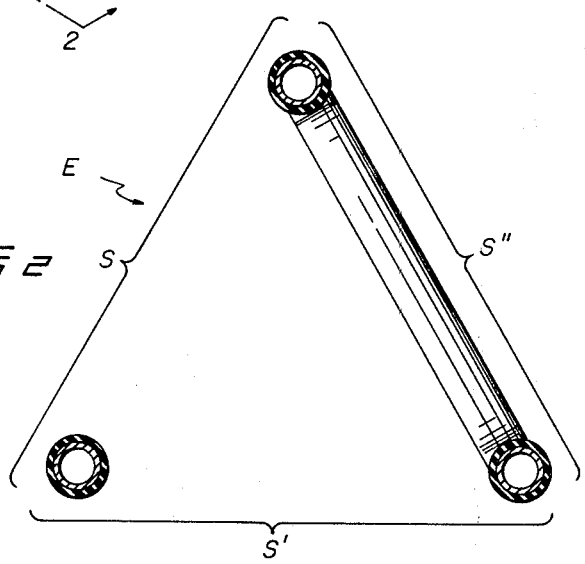
FIG. 2 is a sectional view taken substantially along lines 2—2 of FIG. 1 in the direction of the arrows.
Figure 3:
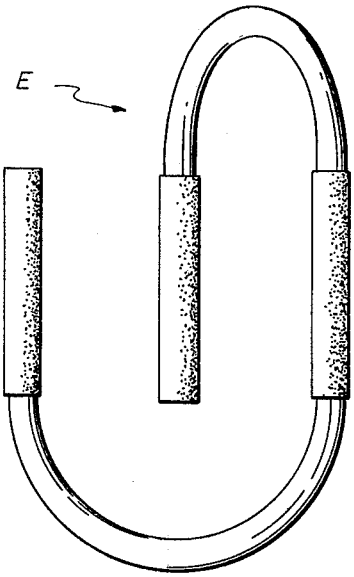
FIG. 3 is a top view of the device of FIG. 1.
Figure 4:
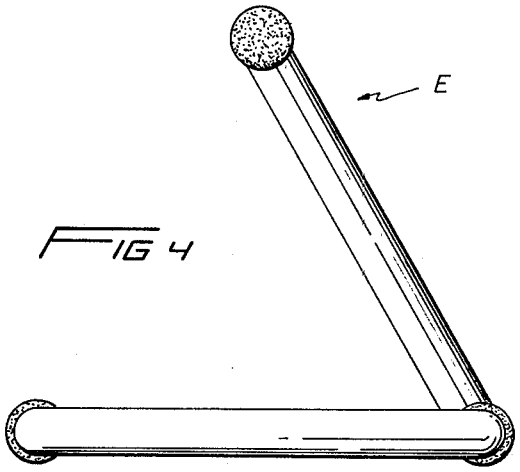
FIG. 4 is an end view of the device of FIG. 1.

In the preferred embodiment, the handgrip areas defined by the tube central portion 13 and the free end portions 17, 18 are of substantially the same length and the U-shaped portions 14, 16 are of substantially identical shape bent as illustrated to form approximately an isosceles triangle as shown in FIG. 2 so that when the body member 11 is positioned on a supporting surface on any of the sides S, S′ and S″ one of the handgrip areas 13, 17, 18 is disposed in an elevated position for gripping by the hand of a user.

The exercise device E of the invention is preferably provided with friction increasing means on each of the handgrip areas 13, 17 and 18 so that not only is the device prevented from slipping on a supporting surface when positioned on any of the sides S, S′ and S″ but slipping between the hand of the user and the exercise device is avoided. More specifically, a sleeve 21 of anti-slip material such as foam rubber or the like is telescopically fitted onto the outer surface 12*a* of the tube 12 within the central portion 13. Similarly, sleeves 22, 23 having closed ends 22*a*, 23*a* respectively are telescopically fitted onto the outer surface 12*a* of the tube 12 along the free end portions 17, 18 of the U-shaped portion 14, 16 respectively. Preferably, the sleeves 22, 23 are composed of the same material or foam rubber as the sleeve 21.

In the use of the invention, a pair of exercise devices E are preferably employed and are arranged in side by side relationship with a spacing suitable for the type of exercise being performed. As explained above, each of the exercise devices E may be placed on a supporting surface on any of the sides S, S′ and S″ as a handgrip area is always available to the user in an elevated position above the supporting surface and the side S, S′ and S″ on which the device E is placed offers a firm support. In addition, when the device E is placed on any of the sides S, S′ and S″ there are always two of the three sleeves 21–23 in contact with the supporting surface to prevent slippage of the device E on a supporting surface or floor. Furthermore, the elevated sleeve being provided with a rubber sleeve prevents the hand of the user from slipping. Thus, with the two devices E in side-by-side relationship and the elevated handgrip area such as is represented by sleeve 23 in the position in FIG. 1, on each of the pair of devices E is grasped by a hand of the user so that the user may do various exercises such as pushups, handstands or the like.

Having thus described the invention, it should be apparent that numerous structural modifications are contemplated as being a part of this invention as set forth hereinabove and as defined hereinbelow by the claims.

What is claimed is:

1. A portable exercise device comprising an elongated body member of rigid material so as to rigidly support the weight of an exerciser using the device, said body member having a substantially straight central portion forming a handgrip area, a first U-shaped portion emanating directly from one side of said central portion and terminating in a first straight free end leg portion, a second U-shaped portion emanating directly from the other side of said central portion and terminating in a second straight free end leg portion, each of said leg portions froming handgrip areas for the exerciser, said first U-shaped portion and said central portion lying in a second plane, said second U-shaped portion and said central portion lying in a second plane angularly disposed to said first plane and toward said first leg portion whereby said second leg portion is spaced above said first plane thereby providing a rigid triangular structure.

2. An exercise device in accordance with claim 1 wherein said body member comprises a metal tube of uniform, cross-sectional shape.

3. An exercise device in accordance with claim 2 wherein said end portions of said U-shaped portions are disposed in substantially parallel, spaced-apart relationship and extend in opposite directions.

4. An exercise device in accordance with claim 3 including friction increasing means on said tube within each of said handgrip areas.

5. An exercise device in accordance with claim 1 wherein all of said handgrip areas are of substantially the same length.

6. An exercise device in accordance with claim 4 wherein said friction increasing means comprise a sleeve of anti-slip material telescopically fitted onto the outer surface of said tube within each of said handgrip areas.

7. An exercise device in accordance with claim 6 wherein each of said U-shaped portions are of substantially identical shape.

8. An exercise device in accordance with claim 7 wherein said sleeves are formed of foam rubber.

9. The device of claim 1 wherein said second leg is substantially equidistant from said first leg portion and said central portion and forming a third plane with said first leg portion thereby providing a rigid triangular configuration symmetrical about said central portion whereby any of said planes is adapted for overlying engagement with a supporting surface to selectively position one of said handgrip areas in an elevated position for gripping by the hand of an exerciser.

* * * * *